US005966101A

United States Patent [19]

Haub et al.

[11] Patent Number: 5,966,101

[45] Date of Patent: Oct. 12, 1999

[54] MULTI-LAYERED COMPACT SLOT ANTENNA STRUCTURE AND METHOD

[75] Inventors: David Ryan Haub, Lake in the Hills; Louis Jay Vannatta, Crystal Lake; Hugh Kennedy Smith, Palatine, all of Ill.

[73] Assignee: Motorola, Inc., Schaumburg, Ill.

[21] Appl. No.: 08/854,197

[22] Filed: May 9, 1997

[51] Int. Cl.[6] ..... H01Q 13/10; H01Q 1/24

[52] U.S. Cl. ..... 343/767; 343/702; 343/770

[58] Field of Search ..... 343/700 MS, 746, 343/850, 702, 767–771

[56] References Cited

U.S. PATENT DOCUMENTS

| | | | |
|---|---|---|---|
| 4,063,246 | 12/1977 | Greiser | 343/769 |
| 4,367,475 | 1/1983 | Schiavone | 343/767 |
| 4,706,050 | 11/1987 | Andrews | 343/700 MS |
| 4,899,164 | 2/1990 | McGrath | 343/700 MS |
| 5,068,670 | 11/1991 | Maoz | 343/767 |
| 5,757,326 | 5/1998 | Koyama et al. | 343/702 |

FOREIGN PATENT DOCUMENTS

| | | |
|---|---|---|
| 1 345 576 | 1/1974 | United Kingdom . |
| 1 457 173 | 12/1976 | United Kingdom . |
| 1 523 117 | 8/1978 | United Kingdom . |
| 2 067 842 | 7/1981 | United Kingdom . |
| 2 166 901 | 5/1986 | United Kingdom . |

OTHER PUBLICATIONS

"Microstrip Lines And Slotlines," by K.C. Gupta, Ramesh Garg, and I.J. Bahl, ARTECH, Chapter 1, Microstrip Lines 1, pp. 1–5, Chapter 5, Slotlines 1, pp. 195–223.

IEEE Transactions On Microwave Theory And Techniques, vol. MTT–17, No. 10, Oct. 1969, "Slot Line On A Dielectric Substrate," by Seymour B. Cohn, Fellow, IEEE, pp. 768–778.

*Primary Examiner*—Don Wong
*Assistant Examiner*—Hoang Nguyen
*Attorney, Agent, or Firm*—Sylvia Chen

[57] ABSTRACT

A multi-layered compact slot antenna shortens the physical length of a slot antenna (710) by using more than one conductive layer, separated by a dielectric layer, to create inductor structures (790, 795) within a slot antenna. Adding inductance to a slot antenna allows a physical reduction in slot length without altering the antenna's radiant frequency range. The geometry of the inductor structures can be designed so that the electric current direction seen about the slot and the electric field direction across the slot is maintained, which aids antenna efficiency and allows arrangements of multiple compact slot antennas. Capacitor structures (780, 785) can also be included to balance out the additional stored magnetic energy in the inductor structures (790, 795).

19 Claims, 8 Drawing Sheets

— PRIOR ART —

110

— PRIOR ART —

210

— PRIOR ART —

— PRIOR ART —

MULTI-LAYERED COMPACT SLOT ANTENNA STRUCTURE AND METHOD

CROSS REFERENCE TO RELATED APPLICATIONS

This application is related to application Ser. No. 08/853,772 entitled "Difference Drive Diversity Antenna Structure and Method" by Louis J. Vannatta, Hugh K. Smith, James P. Phillips, and David R. Haub (Attorney Docket No. CE01547R) filed same date herewith, the specification of which is incorporated herein by reference. This application is also related to application Ser. No. 08/854,282 entitled "Multi-Band Slot Antenna Structure and Method" by Louis J, Vannatta and Hugh K. Smith (Attorney Docket No. CE01548R) filed same date herewith, the specification of which is incorporated herein by reference.

FIELD OF THE INVENTION

This invention relates generally to slot antennas, and more particularly to compact slot antennas that have an electrical length that is longer than the antenna's physical length.

BACKGROUND OF THE INVENTION

Wireless communication devices such as radiotelephones use antennas to transmit and receive radio frequency signals. Various types of antennas available for wireless communication devices include dipole antennas, helical antennas, and slot antennas. Slot antennas can be implemented with a gap in a metal surface. Simple resonant slot antenna geometries include a half wavelength ($\lambda/2$) slot antenna 110 as shown in prior art FIG. 1 and a quarter wavelength ($\lambda/4$) slot antenna 210 as shown in prior art FIG. 2. For a $\lambda/2$ slot antenna 110, the length 140 of the slot 120 is a half wavelength of the frequency of interest and both ends of the slot 120 are closed, while for a $\lambda/4$ slot antenna 210, the length 240 of the slot 220 is a quarter wavelength of the frequency of interest and only one end of the slot 220 is closed while the other end is open. The metal surface of the slot antenna is a ground plane 130, 230 that surrounds each slot 120, 220, and the antenna is driven differentially from positive and negative ports located near a closed end of the slot as shown.

To create a slot antenna that radiates in, for example, the 850 MHz frequency range, a $\lambda/2$ slot antenna 110 would have a slot length 140 of approximately 18 cm while a $\lambda/4$ slot antenna 210 would have a slot length 240 of approximately 9 cm. A 9 cm $\lambda/4$ slot antenna, unfortunately, is physically large for most hand-held radiotelephone applications. Thus, inductive loading has been developed, which slightly shortens the physical length of a slot antenna while maintaining the electrical length.

FIG. 3 shows a prior art quarter wavelength slot antenna 310 shortened using inductive loading. Slot antenna 310 includes a conductive ground plane 330 and is driven differentially from points near the closed end of the slot 320 as shown. The slot 320 has an area 350 where the width of the slot is larger. The configuration of area 350 can be generally rectangular as shown, or it can have other shapes such as circular. The width 370 and the length 360 of the area 350 create an increased impedance along length 360 of the slot. Depending on the length 360, width 370, and shape of the area 350, a five to ten percent reduction in slot length 340 can be achieved while maintaining radiation in the desired frequency band. Further reductions in length cannot be achieved due to physical limitations of the inductive loading technique. In other words, no part of the slot 320 can get wider than the width of the conductive surface that creates the ground plane 330. Also, the narrow section of ground plane that would be along the length 360 between two adjacent slot antennas with inductive loading may be difficult to fabricate.

FIG. 4 shows a prior art quarter wavelength slot antenna 410 shortened using a delay element with a high dielectric constant. A dielectric delay element 450 is inserted in series along a slot having a closed end and an open end. The delay element 450 can be fashioned in a variety of shapes and sizes to create the needed shortening effect. The ground plane of the slot antenna 410 is divided into three ground sections 430, 433, 436 by the delay element 450, and the slot is discontinuous and divided into two slot sections 421, 422 due to the delay element 450. The slot antenna is driven differentially from positive and negative nodes on ground section 430 near the closed end of the slot section 422 as shown.

The dielectric constant of the delay element 450 increases the overall phase delay of the slot antenna 410. Depending upon the length 460 of the delay element 450 and its dielectric constant, a ten to twenty percent reduction in slot length 440 can be achieved while still maintaining radiation in the desired frequency band. Impedance mismatches between the ground section 430, the delay element 450, and the ground sections 433, 436, however, cause undesired reflections that reduce the performance of the antenna.

The prior art inductive loading and delay element methods both furnish a limited decrease in slot length, however, not without some difficulties in manufacture. There is a need for a more dramatic decrease in the length of a slot antenna, and there is also a need for a shorter slot antenna that can be easily constructed to fit on a small wireless communication device such as a hand-held cellular radiotelephone.

DETAILED DESCRIPTION OF THE PREFERRED EMBODIMENTS

The multi-layered compact slot antenna shortens the physical length of a slot antenna by using more than one conductive layer, separated by a dielectric layer, to create inductor structures within a slot antenna. Adding inductance to a slot antenna allows a physical reduction in slot length without altering the antenna's radiant frequency range. The geometry of the inductor structures can be designed so that the electric current direction seen about the slot and the electric field direction across the slot is maintained, which aids antenna efficiency and allows arrangements of multiple compact slot antennas. This multi-layered compact slot antenna is especially applicable to radiotelephones and other hand-held or portable communication devices.

Figure 1:
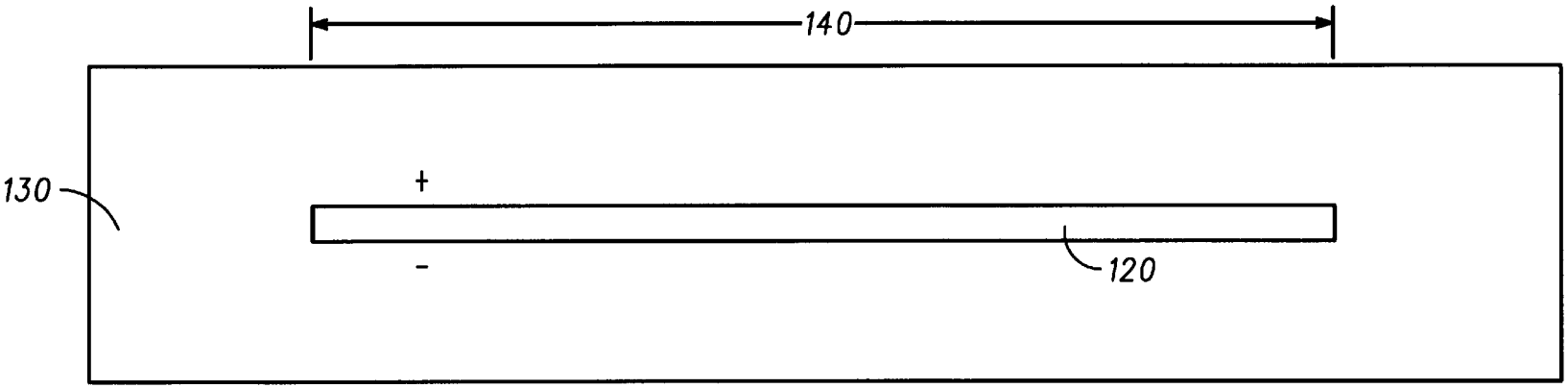
FIG. 1 shows a prior art half wavelength slot antenna.
Figure 2:
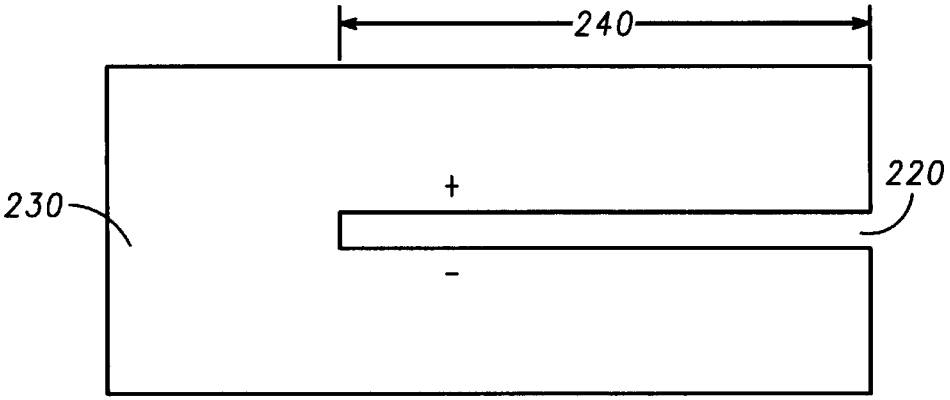
FIG. 2 shows a prior art quarter wavelength slot antenna.
Figure 3:
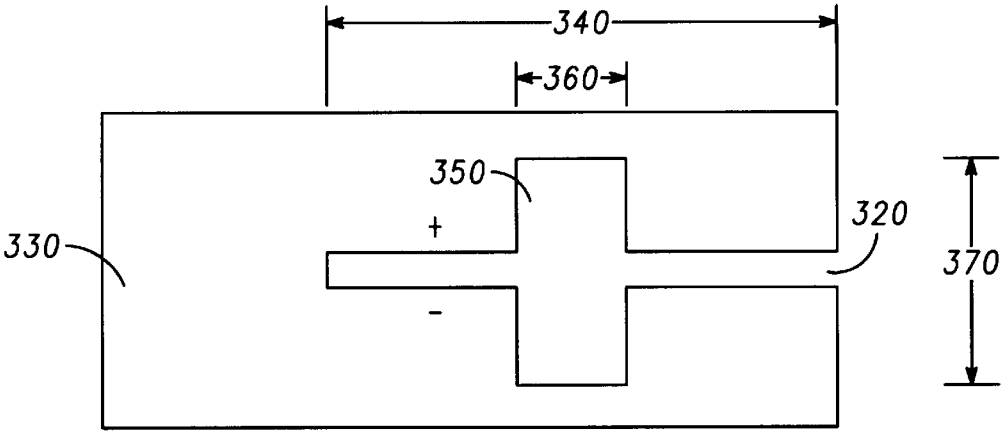
FIG. 3 shows a prior art quarter wavelength slot antenna shortened using inductive loading.
Figure 4:
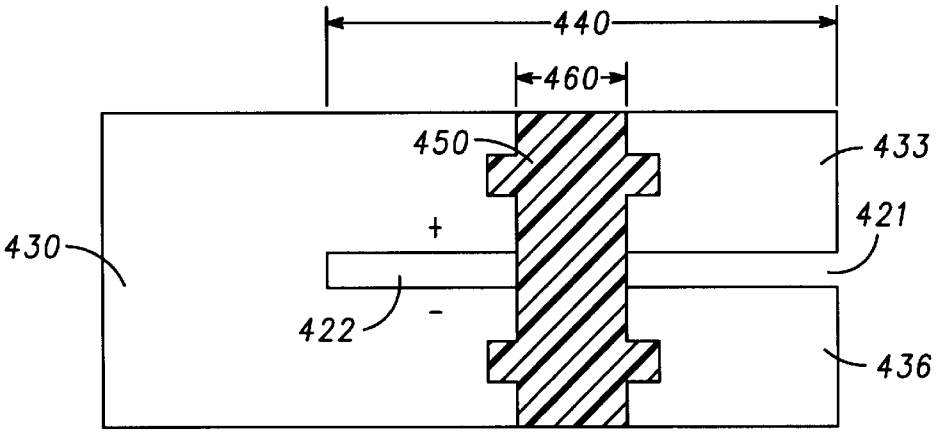
FIG. 4 shows a prior art quarter wavelength slot antenna shortened using dielectric loading.
Figure 5:
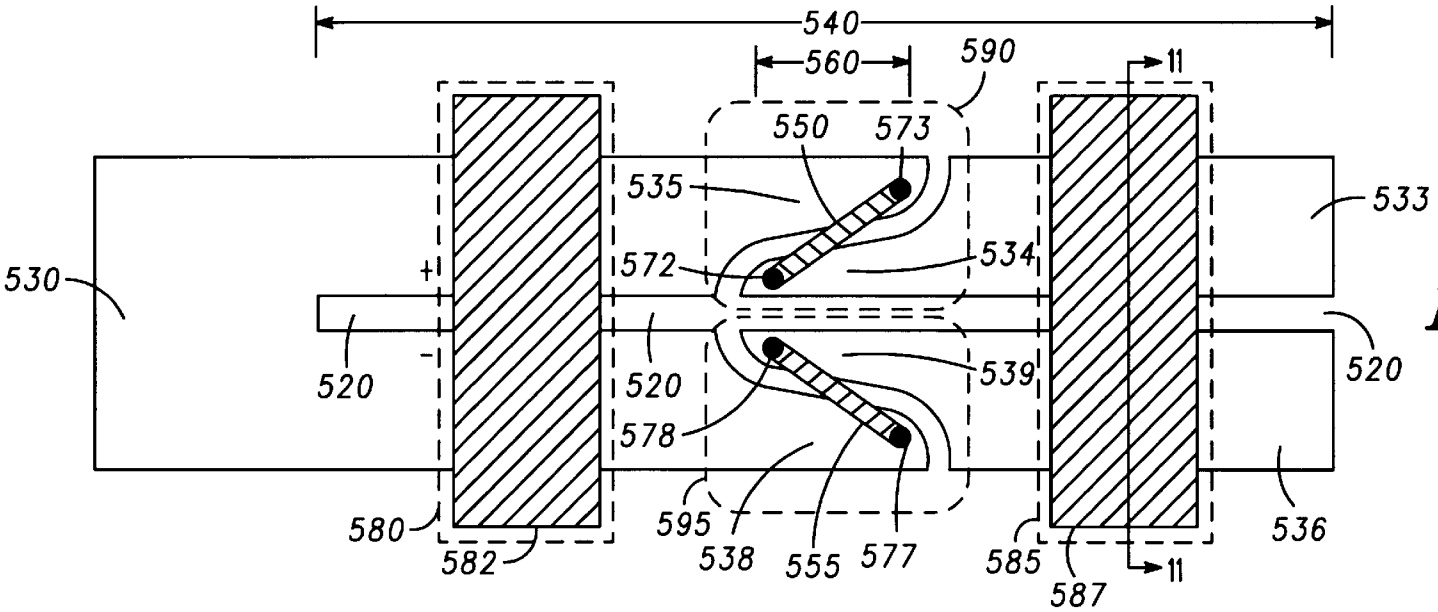
FIG. 5 shows a multi-layered compact slot antenna according to a first preferred embodiment.

FIG. 5 shows a multi-layered compact slot antenna 510 according to a first preferred embodiment. Ground plane sections 530, 533, 536 are in the first conductive layer, and the ground sections are configured to include fingers 534, 535, 538, 539 and a continuous slot 520. Sandwiched between the first conductive layer and a second conductive layer, which is hatched for clarity, lies a continuous dielectric layer separating the two conductive layers. The dielectric layer is not shown here so as to not obscure the details of the two conductive layers. Details of the layered construction of the multi-layered compact slot antenna along line 11—11 are described in reference to FIG. 11. The selection of the dielectric material and the thickness of the dielectric layer is limited only by the intended application of the multi-layered compact slot antenna 510.

In the second conductive layer, which is shown hatched for clarity, extender 550 is part of an inductor structure 590 that connects fingers 534, 535 together using vias 572, 573. Vias are simply conductive areas that provide a direct current path from the first layer to the second layer, through the dielectric layer. Another inductor structure 595 includes extender 555 connecting fingers 538, 539 together using vias 577, 578. Capacitor plates 582, 587 are also included in the second conductive layer. Capacitor plate 582, the part of the conductive ground plane section 530 underlying the capacitor plate 582, and the dielectric layer sandwiched between the capacitor plate 582 and the ground plane section 530, are used to create a capacitor structure 580. Similarly, another capacitor structure 585 is produced by capacitor plate 587, the parts of the ground plane sections 533, 536 underlying the capacitor plate 587, and the interposed dielectric layer. Capacitor structures 580, 585 are used to balance out the additional stored magnetic energy in the inductor structures 590, 595 created by the fingers, extenders, and vias. The capacitor structures 580, 585 can alternately be implemented using discrete capacitor components soldered to the first conductive layer.

The geometry of the fingers 534, 535, 538, 539, extenders 550, 555, and vias 572, 573, 577, 578 create two single-loop inductor structures 590, 595 in the xz-plane, which lengthen the electrical length of the slot antenna 510. The slot antenna 510 is driven differentially from points near the closed end of the slot 520 as shown. Current traveling from the ground plane section 533 crosses under a capacitor plate 587 and enters a finger 534. When the current reaches a via 572, it transfers to the extender 550 in the second layer. At the opposite end of the extender 550, the current returns to the first layer using via 573. In ground plane section 530, the current travels under a capacitor plate 582, rounds the end of the slot 520, travels under the capacitor plate 582 at a second point, and enters a finger 538. The via 577 at the end of the finger 538 brings the current to the extender 555 in the second layer. At the opposite end of the extender 555, via 578 returns the current to the first conductive layer at the finger 539 of ground plane section 536 and crosses under the capacitor plate 587. The length 560 of the inductor structures 590, 595 affects the amount of shortening in slot length 540 that can be achieved using this geometry.

Figure 6:
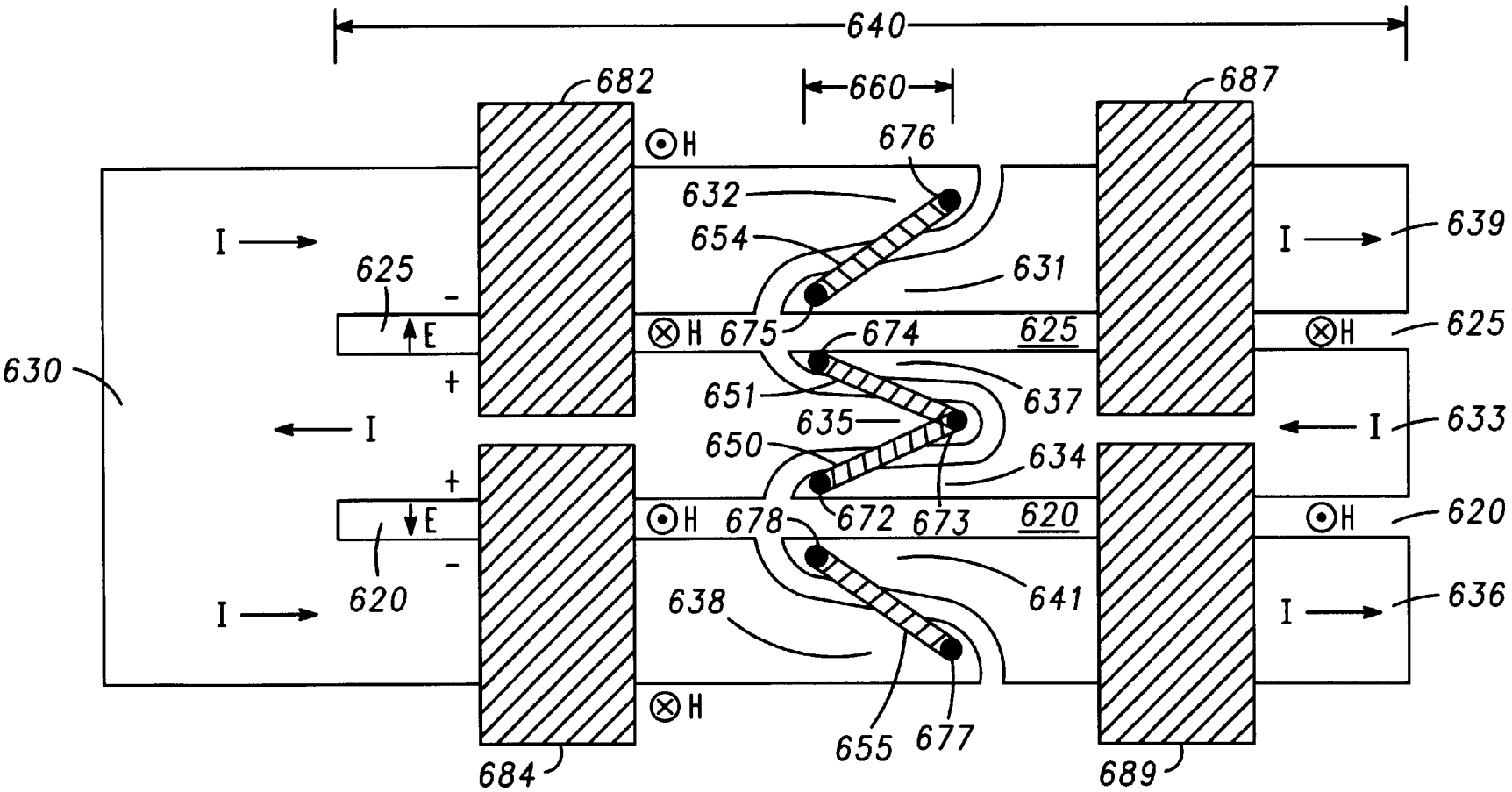
FIG. 6 shows the multi-layered compact slot antenna according to the first preferred embodiment used in a multiple slot antenna arrangement.

In order to use the slot antenna according to the first preferred embodiment in a multiple slot antenna arrangement, the design of the center inductor structure is modified slightly to create a symmetric pattern about the xz-plane. FIG. 6 shows two multi-layered compact slot antennas according to the first preferred embodiment used in a multiple slot antenna arrangement 610. Much like FIG. 5, the antenna is driven differentially using dual ports near the closed end of the slots 620, 625 as shown and has ground plane sections 630, 633, 636, 639 with fingers 631, 632, 634, 635, 637, 638, 641 on a first conductive layer. A continuous dielectric layer separates the first conductive layer from a second conductive layer. The dielectric layer is not shown here so as to not obscure the details of the two conductive layers. Details of the layered construction of the multi-layered compact slot antenna are described in reference to FIG. 11. The selection of the dielectric material and the thickness of the dielectric layer is limited only by the intended application of the multi-layered compact slot antenna 610.

Extenders 650, 651, 654, 655 and capacitor plates 682, 684, 687, 689 are formed on the second conductive layer, hatched for clarity, with vias 672, 673, 674, 675, 676, 677, 678 establishing a direct circuit connection between the first and second conductive layers, through the dielectric layer.

The geometry of the center portion of the antenna structure, which includes a ground plane section 633, fingers 634, 635, 637, and extenders 650, 651, is slightly different than the geometry of the top and bottom portions of the antenna structure. The symmetry of the center portion provides consistent electric fields with vectors E and magnetic fields with vectors H along the length of each slot 620, 625 as shown. In the absence of this symmetry, the magnetic field H would change directions along length 660 of each slot 620, 625, which would result in degraded antenna performance. Like the antenna shown in FIG. 5, the slot length 640 is reduced relative to a conventional quarter wavelength slot antenna that is operational at the same frequencies of interest.

Figure 7:
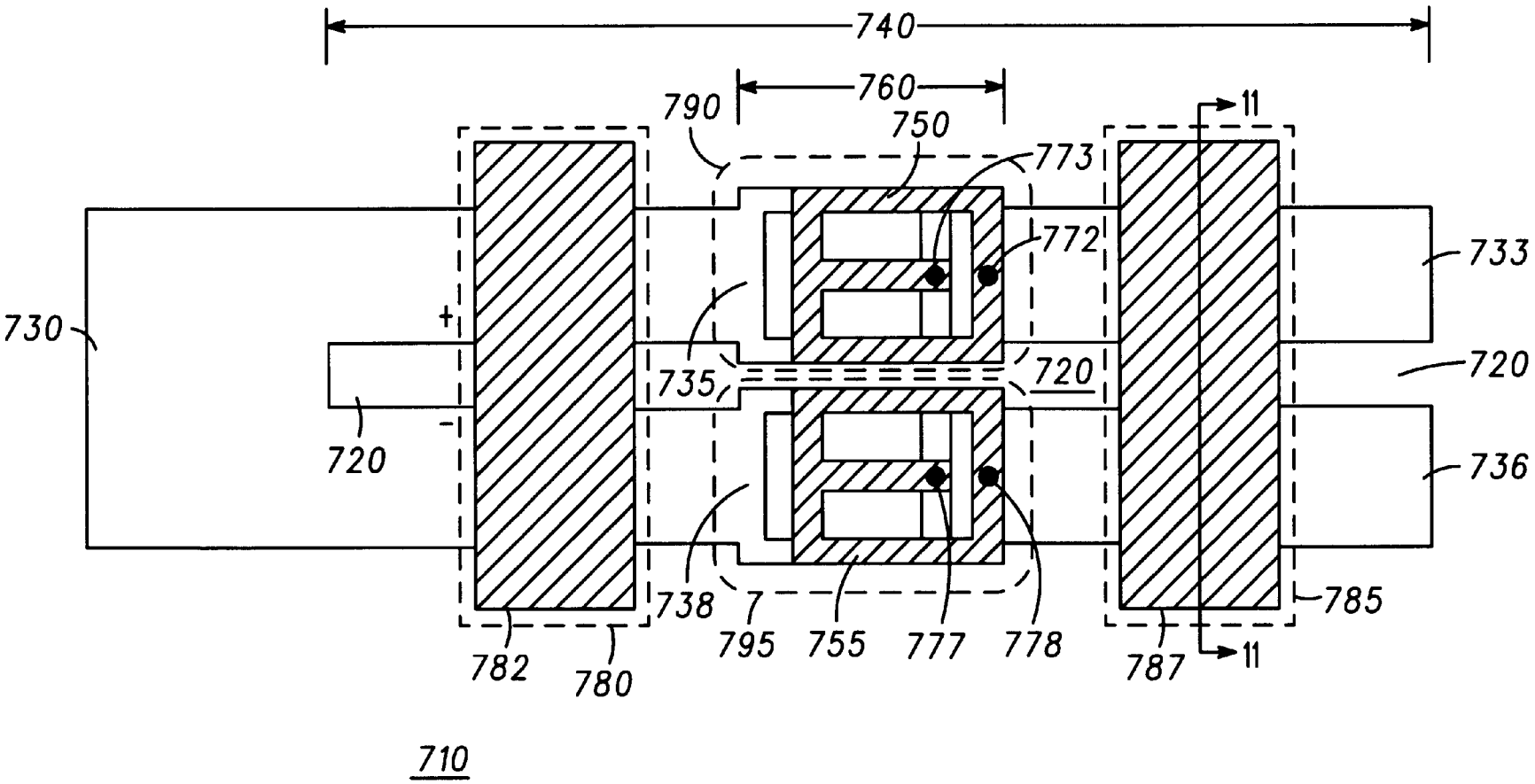
FIG. 7 shows a multi-layered compact slot antenna according to a second preferred embodiment.

Different geometries can be used to increase the inductance of a slot antenna and thus further shorten the physical length of the slot antenna. FIG. 7 shows a multi-layered compact slot antenna 710 according to a second preferred embodiment. This embodiment is designed so that the current direction seen about the slot and the electric field across the slot is consistent across the entire length of the slot antenna 710. A slot 720 is created by ground plane sections 730, 733, 736 in a first conductive layer, and the ground plane sections include fingers 735, 738. The differential driving port is shown near the closed end of the slot 720. Extenders 750, 755 and capacitor plates 782, 787 are in the second conductive layer, which is hatched for clarity. A continuous dielectric layer separates the two conductive layers. The dielectric layer is not shown here so as to not obscure the details of the two conductive layers. Details of the layered construction of the multi-layered compact slot antenna along line 11—11 are described in reference to FIG. 11. The selection of the dielectric material and the thickness of the dielectric layer is limited only by the intended application of the multi-layered compact slot antenna 710. Vias 772, 773, 777, 778 pass current between the first and second conductive layers, through the dielectric layer.

Capacitor plate 782, the part of the conductive ground plane section 730 underlying the capacitor plate 782, and the dielectric layer sandwiched between the capacitor plate 782 and the ground plane section 730, are used to create a capacitor structure 780. Similarly, another capacitor structure 785 is produced by capacitor plate 787, the parts of the ground plane sections 733, 736 underlying the capacitor plate 787, and the interposed dielectric layer. Capacitor structures 780, 785 are used to balance out the additional stored magnetic energy in the inductor structures 790, 795 created by the fingers, extenders, and vias. The capacitor structures 780, 785 can alternately be implemented using discrete capacitor components soldered to the first conductive layer. The geometry of the fingers 735, 738, extenders 750, 755, and vias 772, 773, 777, 778 create two single-loop inductor structures 790, 795 in parallel, which lengthen the electrical length of the slot antenna 710. The length 760 of the inductor structures 790, 795 determines the overall reduction in length 740 of the slot 720 compared to a conventional slot antenna.

Figure 8:
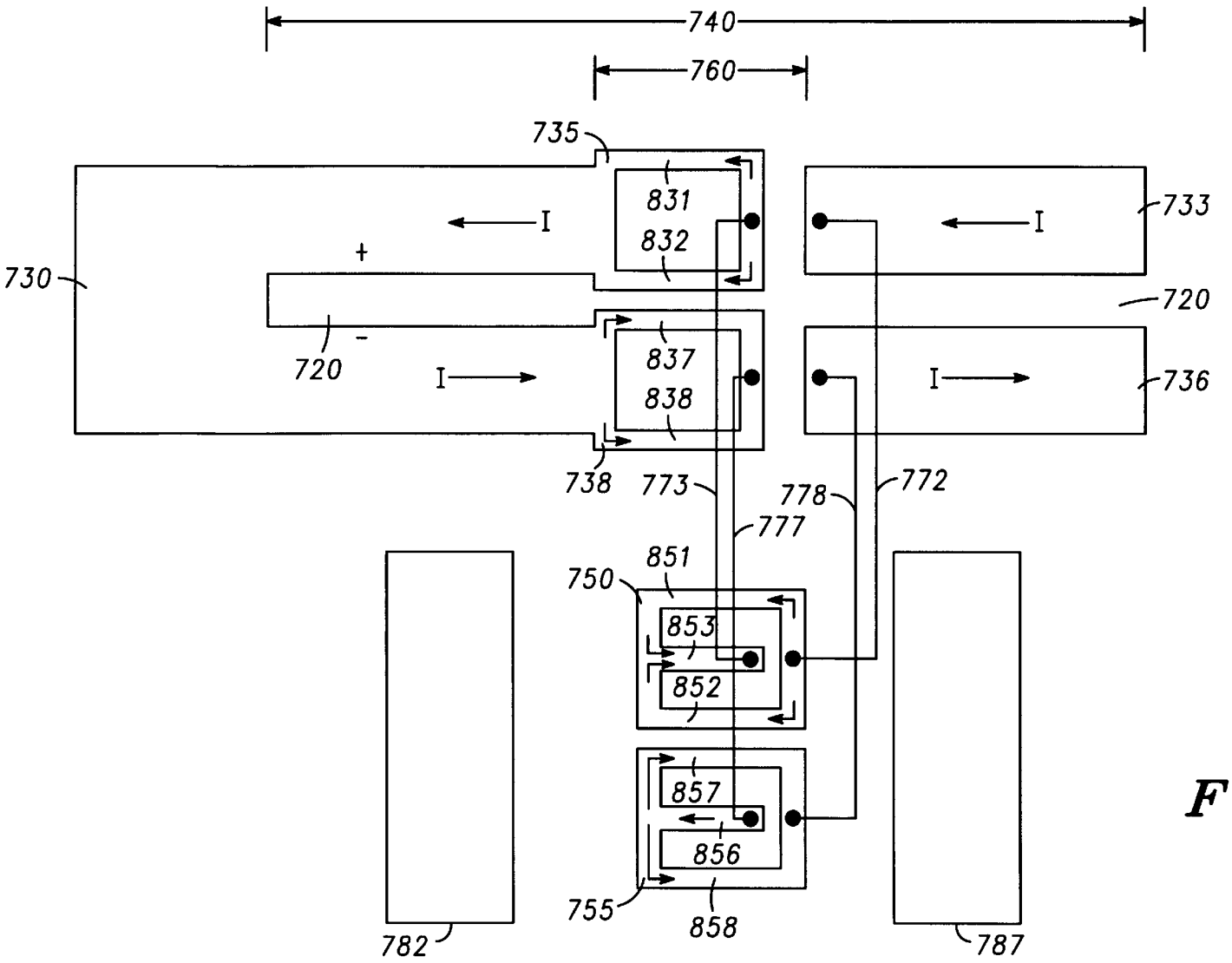
FIG. 8 shows an expanded view of the multi-layered compact slot antenna according to the second preferred embodiment shown in FIG. 7, which details both the first layer and the second layer separately and shows the directions of current flow.

FIG. 8 shows an expanded view of the multi-layered compact slot antenna according to the second preferred embodiment shown in FIG. 7, which details both the first conductive layer and the second conductive layer separately and shows the directions of current flow. Current traveling from a ground plane section 733 passes under capacitor plate 787 to a via 772. The via 772 transfers the current to the extender 750 in the second layer. The extender 750 splits the current between two paths 851, 852 as shown by the directional arrows. The two paths are rejoined at the tongue portion 853 of the extender 750. When the current reaches the via 773 at the end of the tongue portion 853, it returns to the first layer on ground plane section 730 only to be split again into paths 831, 832 as shown by the directional arrows. At the end of the two paths, the current is rejoined.

The rejoined current travels under a capacitor plate 782, around the end of the slot 720, and under the capacitor plate 782 at another point. At the finger 738, the current again separates into two paths 837, 838 as shown by the directional arrows. At the far end of the finger 738, the currents are rejoined and a via 777 brings the current to the extender 755 in the second layer. The current travels along tongue portion 856 and splits at the end of the tongue portion 856 into two separate paths 857, 858 as shown by the directional arrows. At via 778, the currents from the separate paths 857, 858 rejoin and transfer back to the first layer at ground plane section 736. The current again passes under capacitor plate 787.

The inductance caused by current traveling in the same direction on multiple paths 831, 851; 832, 852; 837, 857; 838, 858, which are co-located in the xy-plane, allows for significant shortening of the physical length of the slot antenna. The tongue portions 853, 856 of the extenders 750, 755 in the second layer do not overlap any structure on the first layer, and thus have little effect on the inductance of the geometry. The length 760 of inductor structures 790, 795 determines the amount of shortening that can be achieved using this geometry. The length of a slot antenna having the geometry shown can be decreased by approximately twenty-five percent compared to a conventional quarter wavelength slot antenna operational in the same frequency band.

Figure 9:
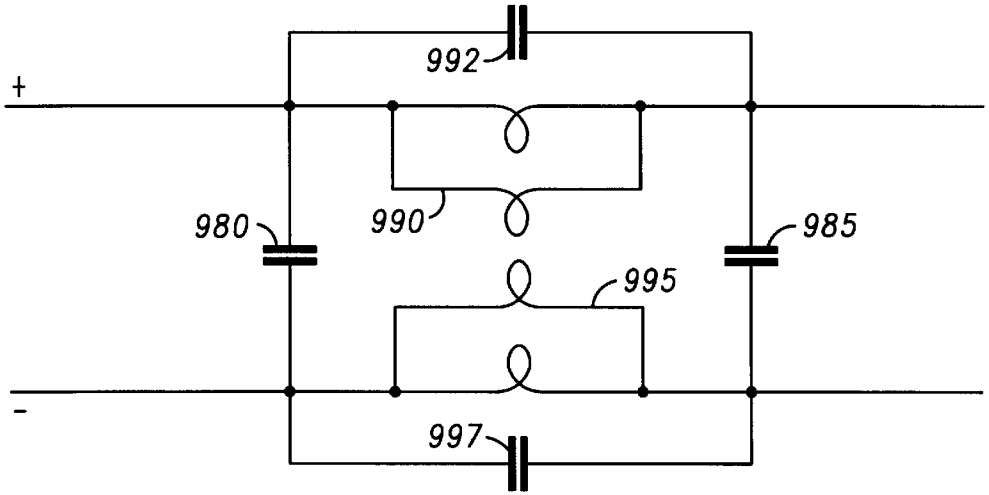
FIG. 9 shows a first-order equivalent circuit for the multi-layered compact slot antenna according to the second preferred embodiment shown in FIGS. 7 and 8.

FIG. 9 shows the first order equivalent circuit for the multi-layered compact slot antenna according to the second preferred embodiment shown in FIGS. 7 and 8. Capacitors 980, 985 are formed by capacitor structures 780, 785 (shown in FIGS. 7 and 8). Two twin-loop inductors 990, 995 are formed by the dual finger, via, and extender structures along length 760 (shown in FIGS. 7 and 8). One twin-loop inductor 990 is formed by the current through paths 831, 851 and paths 832, 852 shown in FIG. 8. The second twin-loop inductor 995 is formed by the current through paths 837, 857 and paths 838, 858. The co-location of the finger paths and the extender paths 831, 851; 832, 852; 837, 857; 838, 858 in the xy-plane of the inductor structure also creates parasitic capacitors 992, 997. Because inductors are created by the geometry of the multi-layer compact slot antenna, the antenna should be designed to insure that the inductors are not near self-resonance.

Figure 10:
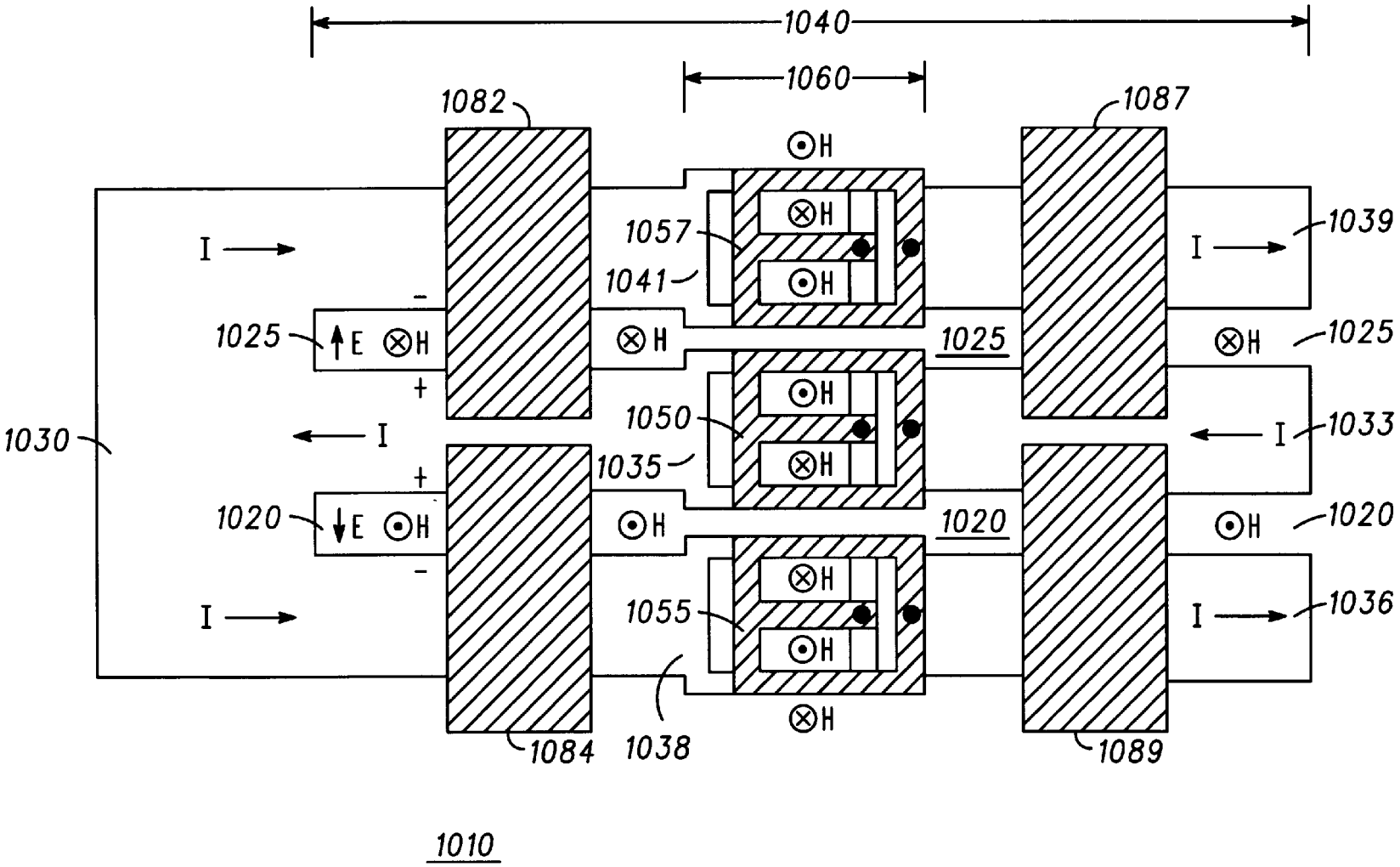
FIG. 10 shows the multi-layered compact slot antenna according to the second preferred embodiment used in a multiple slot antenna arrangement.

FIG. 10 shows two multi-layered compact slot antennas according to the second preferred embodiment used in a multiple slot antenna arrangement 1010. Because the direction of the current flow is consistent (i.e., symmetrical about the xz-plane) at both edges of the inductor structure (shown in FIG. 8), the slot antenna can easily be repeated to produce a multiple slot antenna arrangement 1010. Two slots 1020, 1025 and three inductor structures are shown. A first conductive layer includes ground plane sections 1030, 1033, 1036, 1039 having fingers 1035, 1038, 1041. A second conductive layer includes capacitor plates 1082, 1084, 1087, 1089 and extenders 1050, 1055, 1057. A continuous dielectric layer separates the first conductive layer from a second conductive layer. The dielectric layer is not shown here so as to not obscure the details of the two conductive layers. Details of the layered construction of the multi-layered compact slot antenna are described in reference to FIG. 11. The selection of the dielectric material and the thickness of the dielectric layer is limited only by the intended application of the multi-layered compact slot antenna arrangement 1010. The geometry of the multiple slot antenna arrangement 1010 is similar to the geometry described in detail with respect to FIGS. 7 and 8.

The antenna is driven differentially using dual ports at points near the closed ends of the slots 1020, 1025 as shown. Vectors I show the current flow at various points of the multiple slot antenna arrangement, vectors H show the magnetic field at various points of the multiple slot antenna arrangement, and vectors E show the electric field at various points of the multiple slot antenna arrangement. The magnetic, electric, and current fields remain consistent at all points of each slot 1020, 1025. This allows a greater antenna efficiency. Also, due to the geometry of the inductor structures created by extenders 1050, 1055, 1057, fingers 1035, 1038, 1041, and the vias, additional slots can easily be added to the multiple slot antenna arrangement 1010. The length 1060 of the inductor structures determines the overall reduction in length 1040 of the slot 1020 compared to a conventional slot antenna.

Figure 11:
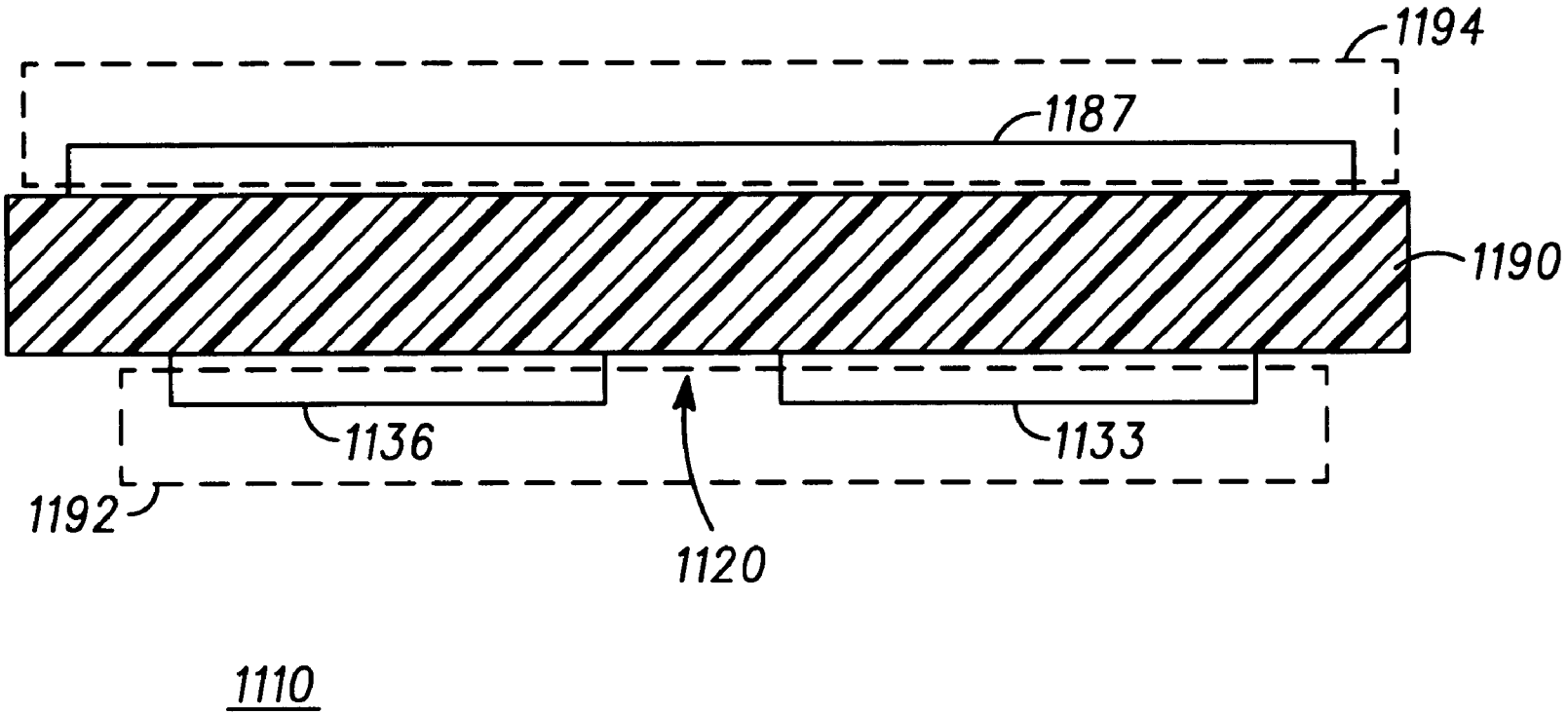
FIG. 11 shows a cross section of a multi-layered compact slot antenna according to a preferred embodiment.

FIG. 11 shows a cross section of a multi-layered compact slot antenna 1110 according to a preferred embodiment. This cross section is similar, whether taken along line 11—11 of FIG. 5 or along line 11—11 of FIG. 7, and shows details of the dielectric layer 1190 between the two conductive layers of the multi-layered slot antenna 1110.

The first conductive layer 1192 includes ground plane sections 1133, 1136, which are similar to ground plane sections 533, 536 shown in FIG. 5 or ground plane sections 733, 736 shown in FIG. 7. Note that a slot 1120 lies between the two ground plane sections 1133, 1136, similar to slot 520 shown in FIG. 5 or slot 720 shown in FIG. 7. The second conductive layer 1194 includes capacitive plate 1187, which is similar to capacitor plate 587 shown in FIG. 5 or capacitor plate 787 shown in FIG. 7. The first conductive layer 1192 is separated from the second conductive layer 1194 by a continuous dielectric layer 1190.

Thus, the compact slot antenna provides simple methods for reducing the physical length of a slot antenna while maintaining the desired radiant frequency range. Certain embodiments of the compact slot antenna are easily adaptable to multiple slot antenna arrangements. Also, while the compact slot antennas shown are shortened quarter wavelength slot antennas, the same shortening approaches can also be applied to half wavelength slot antennas. While specific components and functions of the compact slot antenna are described above, fewer or additional functions could be employed by one skilled in the art within the true spirit and scope of the present invention. The invention should be limited only by the appended claims.

We claim:

1. A multi-layered slot antenna comprising:

a first conductive layer implementing a radiating slot;

a second conductive layer;

a dielectric layer sandwiched between the first conductive layer and the second conductive layer; and a first loop inductor structure directly connected to the first conductive layer.

2. A multi-layered slot antenna according to claim 1 wherein the radiating slot is open at one end and closed at another end.

3. A multi-layered slot antenna according to claim 1 wherein the first loop inductor structure comprises:

a first extender implemented in the second conductive layer; and a first via through the dielectric layer connecting the first conductive layer to the first extender.

4. A multi-layered slot antenna according to claim 3 wherein the first loop inductor structure further comprises:

a second via through the dielectric layer connecting the first conductive layer to the first extender.

5. A multi-layered slot antenna according to claim 4 wherein the first conductive layer further comprises:

a first ground plane section; and a second ground plane section discontinuous from the first ground plane section.

6. A multi-layered slot antenna according to claim 5 wherein the first via connects the first ground plane section to the first extender.

7. A multi-layered slot antenna according to claim 6 wherein the second via connects the second ground plane section to the first extender.

8. A multi-layered slot antenna according to claim 1 further comprising:

a second loop inductor structure coupled to the first conductive layer.

9. A multi-layered slot antenna according to claim 1 further comprising:

a first capacitor structure coupled to the first conductive layer.

10. A multi-layered slot antenna according to claim 9 wherein the first capacitor structure comprises:

a first capacitor plate implemented in the second conductive layer;

a portion of the first conductive layer opposing the first capacitor plate; and a portion of the dielectric layer sandwiched between the portion of the first conductive layer and the first capacitor plate.

11. A multi-layered slot antenna according to claim 10 wherein the first conductive layer further comprises:

a first ground plane section; and a second ground plane section discontinuous from the first ground plane section.

12. A multi-layered slot antenna according to claim 11 wherein the portion of the first conductive layer opposing the first capacitor plate is in the first ground plane section.

13. A multi-layered slot antenna according to claim 12 wherein the portion of the first conductive layer opposing the first capacitor plate is in the second ground plane section.

14. A multi-layered slot antenna according to claim 9 further comprising:

a second capacitor structure coupled to the first conductive layer.

15. A radiotelephone comprising:

a first conductive layer implementing a radiating slot;

a second conductive layer implementing an extender of an inductor structure;

a dielectric layer sandwiched between the first conductive layer and the second conductive layer; and a first via through the dielectric layer connecting the first conductive layer to the extender.

16. A radiotelephone according to claim 15 further comprising:

a capacitor structure coupled to the first conductive layer.

17. A radiotelephone according to claim 16 wherein the capacitor structure comprises:

a first capacitor plate implemented in the second conductive layer;

a portion of the first conductive layer opposing the first capacitor plate; and a portion of the dielectric layer sandwiched between the portion of the first conductive layer and the first capacitor plate.

18. A method for constructing a compact slot antenna comprising the steps of:

implementing a radiating slot in a first conductive layer;

implementing an extender of an inductor structure in a second conductive layer;

sandwiching a dielectric layer between the first conductive layer and the second conductive layer; and directly connecting the extender to the first conductive layer.

19. A method for constructing a compact slot antenna according to claim 18 further comprising the step of:

coupling a capacitor structure to the first conductive layer.

* * * * *